US008096903B1

(12) United States Patent
Brown, II

(10) Patent No.: US 8,096,903 B1
(45) Date of Patent: Jan. 17, 2012

(54) DEVICE FOR CONNECTING A SOCCER NET TO THE HORIZONTAL CROSSBAR OF A SOCCER GOAL AND METHOD OF USE

(76) Inventor: Richard A. Brown, II, Long Beach, CA (US)

( * ) Notice: Subject to any disclaimer, the term of this patent is extended or adjusted under 35 U.S.C. 154(b) by 0 days.

(21) Appl. No.: 13/083,113

(22) Filed: Apr. 8, 2011

(51) Int. Cl.
*A63B 63/00* (2006.01)

(52) U.S. Cl. ..... 473/478; 473/494; 248/74.3

(58) Field of Classification Search ..... 473/416, 473/478, 494, 491, 477; 24/339, 343, 555; 248/231, 74.3; 280/47.34; 285/124.2; D8/356, D8/381, 382, 383, 395
See application file for complete search history.

(56) References Cited

U.S. PATENT DOCUMENTS

| | | | | | |
|---|---|---|---|---|---|
| 451,097 | A * | 4/1891 | Wilkinson | 211/74 |
| 1,438,043 | A * | 12/1922 | Kohnle | 40/662 |
| 1,861,151 | A * | 5/1932 | Buschman | 439/575 |
| 3,521,332 | A * | 7/1970 | Kramer | 403/188 |
| 4,306,697 | A * | 12/1981 | Mathews | 248/68.1 |
| 4,703,931 | A * | 11/1987 | Steen | 473/435 |
| 4,934,540 | A * | 6/1990 | Novak | 211/124 |
| 6,061,880 | A * | 5/2000 | Senninger | 24/339 |
| 6,142,892 | A * | 11/2000 | Dennis | 473/494 |
| 6,158,700 | A * | 12/2000 | Shieh | 248/74.2 |
| 6,383,096 | B1 * | 5/2002 | Green | 473/415 |
| 2003/0224884 | A1 * | 12/2003 | Oister et al. | 473/478 |
| 2008/0076606 | A1 * | 3/2008 | Siefker | 473/446 |

* cited by examiner

*Primary Examiner* — Gene Kim
*Assistant Examiner* — M Chambers
(74) *Attorney, Agent, or Firm* — Timothy Thut Tyson; Ted Masters; Leon D. Rosen & Associates, P.C.

(57) ABSTRACT

A device for connecting a soccer net to the horizontal crossbar of a soccer goal eight feet above the ground without using a ladder includes a resilient clip having an inner surface which is shaped and dimensioned to receive the horizontal crossbar and a line long enough to be thrown over the crossbar and hang down low enough to be reached and pulled down. The clip is attached to the edge cord of the net. The line is then thrown over the crossbar and pulled down raising the clip and net to the crossbar until the mouth of the clip is facing downward on the top of the crossbar. The line and net are then pulled down simultaneously forcing the mouth of the resilient clip to open, receive, and clamp on the horizontal cross bar. Conversely, when the net is to be removed, the line is thrown over the crossbar in the opposite direction and the line is pulled down until the clip is rotated until the mouth of the clip is facing upward on the crossbar. The line and clip are then pulled down simultaneously forcing the mouth of the resilient clip to open and disengage from the crossbar.

10 Claims, 9 Drawing Sheets

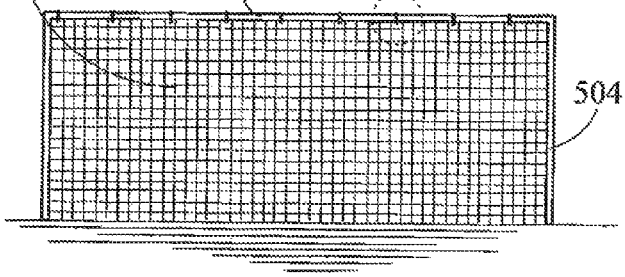
Fig. 1
PRIOR ART
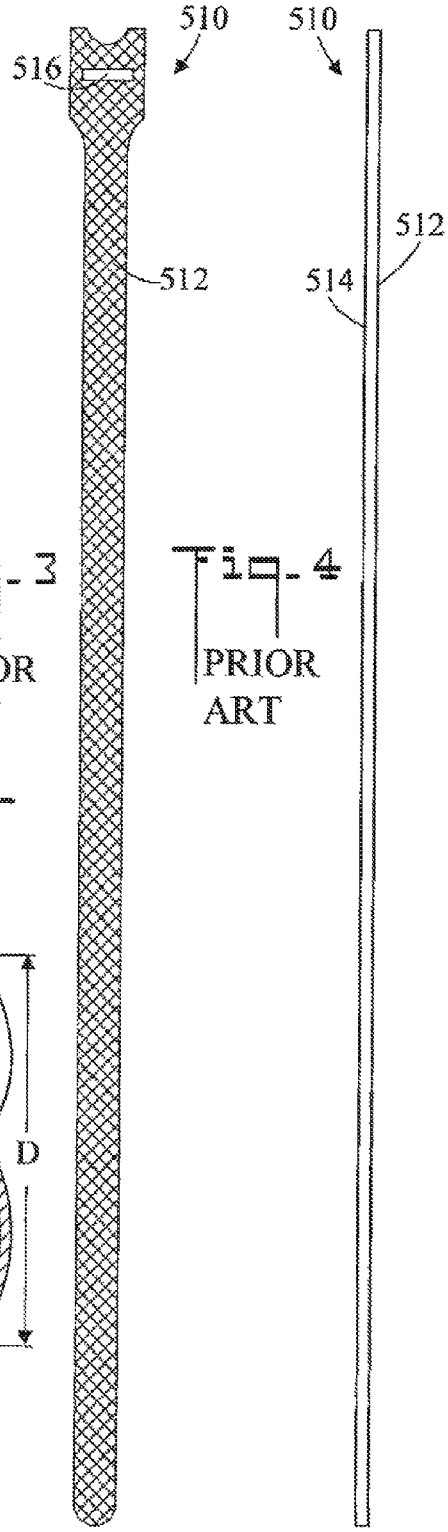
Fig. 3
PRIOR ART
Fig. 4
PRIOR ART
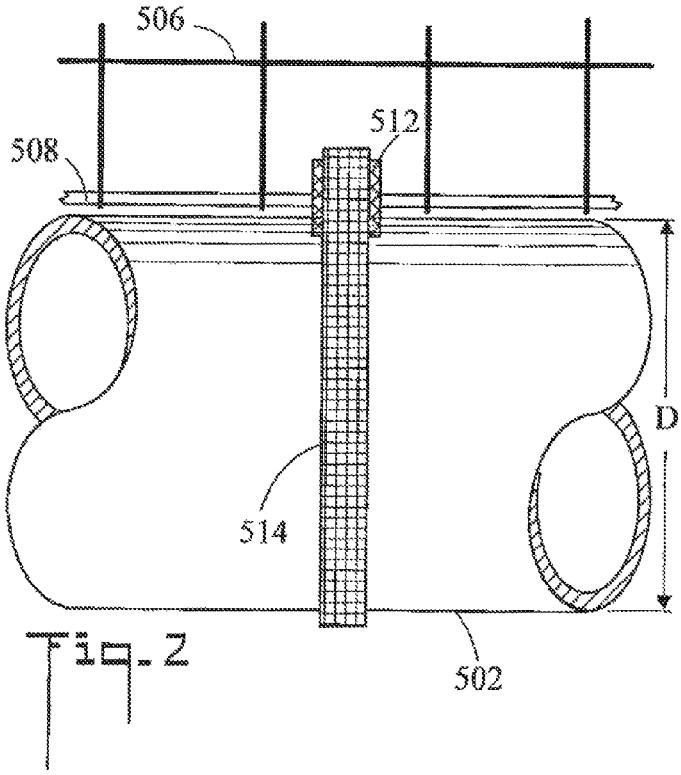
Fig. 2

502

502
502
36
36
FIELD SIDE
GOAL SIDE
20
32
508
506
36
40
20
40
22
506
20
22
506
506

DEVICE FOR CONNECTING A SOCCER NET TO THE HORIZONTAL CROSSBAR OF A SOCCER GOAL AND METHOD OF USE

TECHNICAL FIELD

The present invention pertains generally to the game of soccer, and more particularly to a device for connecting a soccer net to the horizontal crossbar of a soccer goal.

BACKGROUND OF THE INVENTION

In the game of soccer, a rectangular goal is positioned at the middle of each goal line. The goal includes a horizontal crossbar which resides atop two vertical goal posts. The goal posts are eight feet high and placed 24 feet apart. A soccer net is connected at multiple points to the both the goal posts and the horizontal crossbar The net connections are typically effected by hook and loop net fasteners (ties), and the connection points are close enough to prevent a soccer ball from passing between the net and poles or crossbar.

When the soccer net is installed or removed, before or after a practice or game, most adults cannot reach the eight foot crossbar to manipulate the net fasteners. As such, a ladder or other stand is needed to attach and detach the net. Alternatively, a child can be balanced on the shoulders of an adult to manipulate the net fasteners.

BRIEF SUMMARY OF THE INVENTION

The present invention is directed to a device for connecting a soccer net to the horizontal crossbar of a soccer goal. The device allows the soccer net to be connected to and disconnected from the eight foot high horizontal crossbar without the need of a ladder or other stand.

In accordance with an embodiment, a device is disclosed for connecting a soccer net to the horizontal crossbar of a soccer goal, the soccer net having an edge cord and the horizontal crossbar being circular and having a diameter. The device includes a clip having an inner surface which is shaped and dimensioned to receive the horizontal crossbar. The clip has a first jaw and an opposite second jaw, the first and second jaws form a mouth which has a width which is less than the diameter of the horizontal crossbar. The first jaw includes an edge cord connector which is shaped and dimensioned to receive the edge cord of the soccer net. The second jaw includes a line connector. The clip is resilient so that the first and second jaws can open to receive the horizontal crossbar, and once received, close around the horizontal crossbar.

In accordance with another embodiment, the edge cord connector includes a bight in the first jaw. The bight has a neck through which the edge cord can pass.

In accordance with another embodiment, the bight has an elongated portion.

In accordance with another embodiment, the line connector is a hole in the second jaw.

In accordance with another embodiment, a line connects to line connector.

In accordance with another embodiment, the clip has an inner diameter. The edge cord connector is located about 23° from the inner diameter, and the line connector is located about 30° from the inner diameter.

Other possible embodiments, in addition to the possible embodiments enumerated above, will become apparent from the following detailed description, taken in conjunction with the accompanying drawings, which illustrate, by way of example, the principles of the device and method of use.

BRIEF DESCRIPTION OF THE DRAWINGS

FIG. 1 is a reduced front elevation view of a prior art soccer goal;

FIG. 2 is an enlarged view in direction 2 of FIG. 1;

FIG. 3 is a top plan view of a prior art soccer net fastener;

FIG. 4 is a side elevation view of the soccer net fastener;

DETAILED DESCRIPTION OF THE INVENTION

Figure 5:
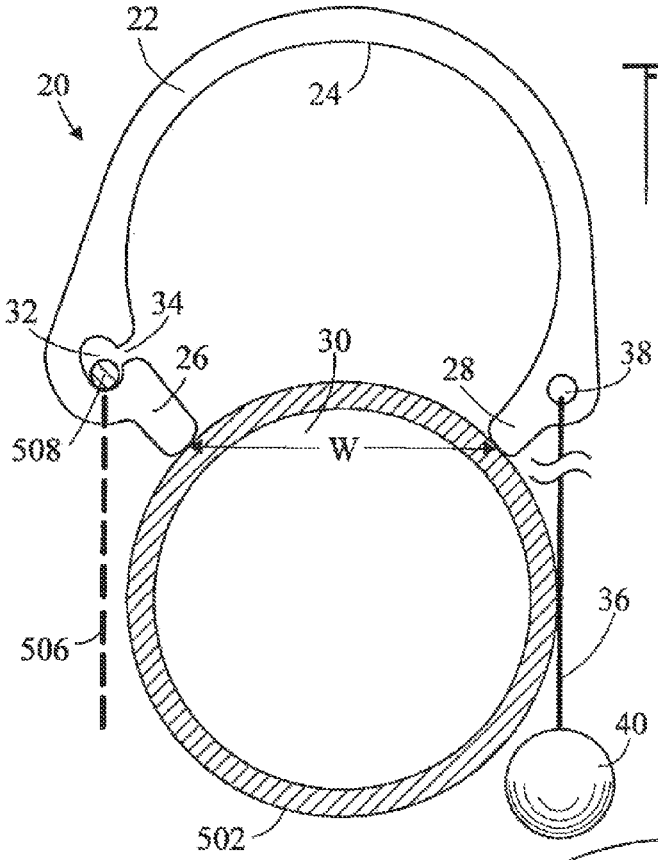
FIG. 5 is a side elevation view of a device for connecting a soccer net to the horizontal crossbar of a soccer goal showing the device in position ready to be connected to the horizontal crossbar of the soccer goal.

Referring initially to FIG. 1, there is illustrated a reduced front elevation view (from the field side) of a prior art soccer goal, generally designated as 500. Soccer goal 500 includes a horizontal crossbar 502 which is supported by two goal posts 504. A soccer net 506 is attached to horizontal crossbar 502 and goal posts 504.

FIG. 2 is an enlarged view in direction 2 (top view) of FIG. 1 showing horizontal crossbar 502 and soccer net 506, and FIGS. 3 and 4 are top plan and side elevation views, respectively, of a prior art soccer net fastener 510. Horizontal crossbar 502 is circular (has a circular cross section), and has a diameter D (outer diameter) of about three inches. Soccer net 506 includes an edge cord 508 to which the vertical elements of the net are connected. Soccer net fastener 510 is an elongated strip having one of a hook and loop fastener 512 on one side, and the other of the hook and loop fastener 514 on the opposite side. The soccer net fastener 510 has a slot 516. Soccer net fastener 510 is placed around edge cord 508, and the free end of the soccer net fastener 510 is passed through slot 516 cinching edge cord 508 to soccer net fastener 510. Soccer net fastener 510 and attached soccer net 506 are then lifted to the horizontal crossbar 502 and soccer net fastener 510 is wrapped around crossbar 502. The two ends of soccer net fastener 510 are then pressed together to retain soccer net fastener 510 and soccer net 506 on horizontal crossbar 502. Since the horizontal crossbar 502 is eight feet off the ground, the person making the attachment must be standing on a ladder or other stand.

Figure 6:
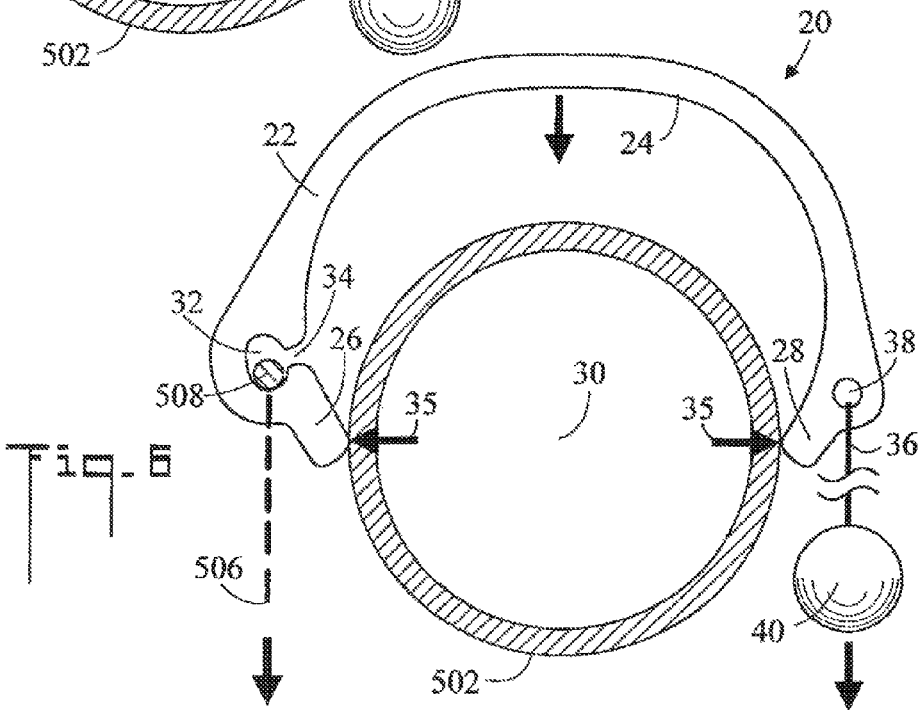
FIG. 6 is a side elevation view of the device being pulled down onto the horizontal crossbar of the soccer goal.
Figure 7:
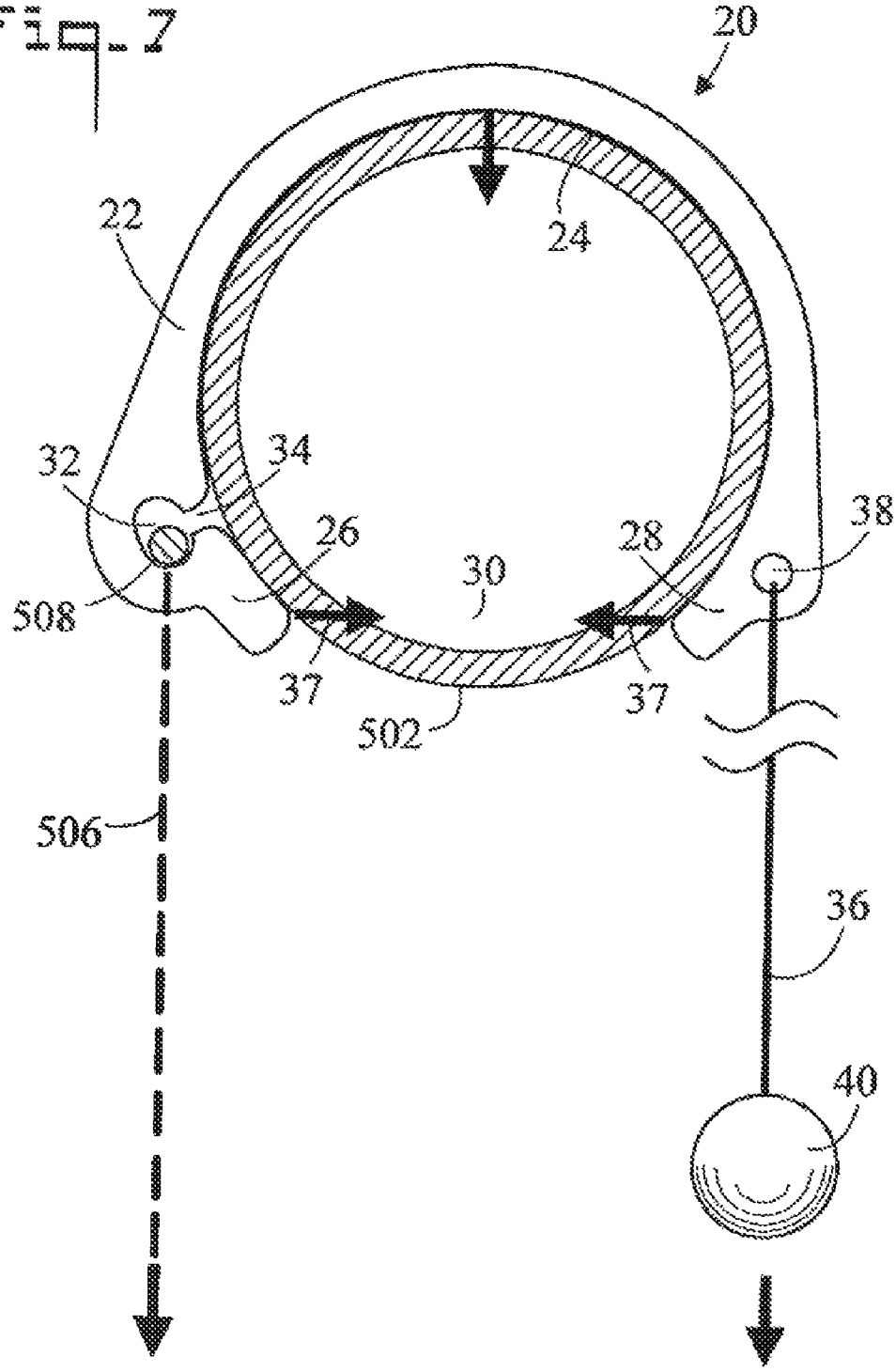
FIG. 7 is a side elevation view of the device connected to the horizontal crossbar of the soccer goal.

Referring now to FIG. 5, there is illustrated a side elevation view of a device generally designated as 20 for connecting soccer net 506 to horizontal crossbar 502 of soccer goal 500 showing the device 20 in position ready to be connected to horizontal crossbar 502 of soccer goal 500. FIG. 6 is a side elevation view of device 20 being pulled down onto horizontal crossbar 502 of soccer goal 500, and FIG. 7 is a side elevation view of device 20 connected to horizontal crossbar 502 of soccer goal 500. Also referring to FIGS. 8-10, device 20 includes a clip 22 which has an inner surface 24 which is shaped and dimensioned to receive horizontal crossbar 502. In the shown embodiment, inner surface 24 of clip 22 forms a partial circle which closely and releasably receives horizontal crossbar 502. Clip 22 has first jaw 26 and an opposite second jaw 28, first 26 and second 28 jaws forming a mouth 30 having a width W which is less than diameter D of horizontal crossbar 502. It is noted that width W is the width when clip 22 is unexpanded. First jaw 26 includes an edge cord connector 32 which is shaped and dimensioned to receive edge cord 508 (also refer to FIG. 2) of soccer net 506. In the shown embodiment edge cord connector 32 includes a bight in first jaw 26. The bight has a neck 34 through which edge cord 508 can pass. Neck 34 is just wide enough to pass edge cord 508. Second jaw 28 includes a line connector. A line 36 (such as a cord, sting, wire, or the like) connects to the line connector. In the shown embodiment, line connector includes a hole 38 in second jaw 28 through which line 36 is passed and secured. Clip 22 is fabricated from a resilient material such as polypropylene or nylon, so that first 26 and second 28 jaws can open to receive horizontal crossbar 502 as shown in FIG. 6, and once received, close around horizontal crossbar 502 to connect device 20 to horizontal crossbar 502 as is shown in FIG. 7. Line 36 must be long enough to be thrown over eight foot horizontal crossbar 502 and hang down low enough to be reached and pulled down (refer to FIGS. 12-22). A grab ball 40 is connected to the distal end of line 36, and is used to pull and otherwise manipulate line 36.

In FIG. 5, clip 22 has been positioned on top of horizontal cross bar 502 so that mouth 30 opens downwardly. In FIG. 6, soccer net 506 and line 36 are simultaneously pulled down thereby causing mouth 30 of clip 22 to resiliently open as is indicated by arrows 35 and receive horizontal crossbar 502. In FIG. 7, the downward pulling has continued until clip 22 resiliently clamps around and closely receives horizontal crossbar 502 as indicated by arrows 37.

Figure 8:
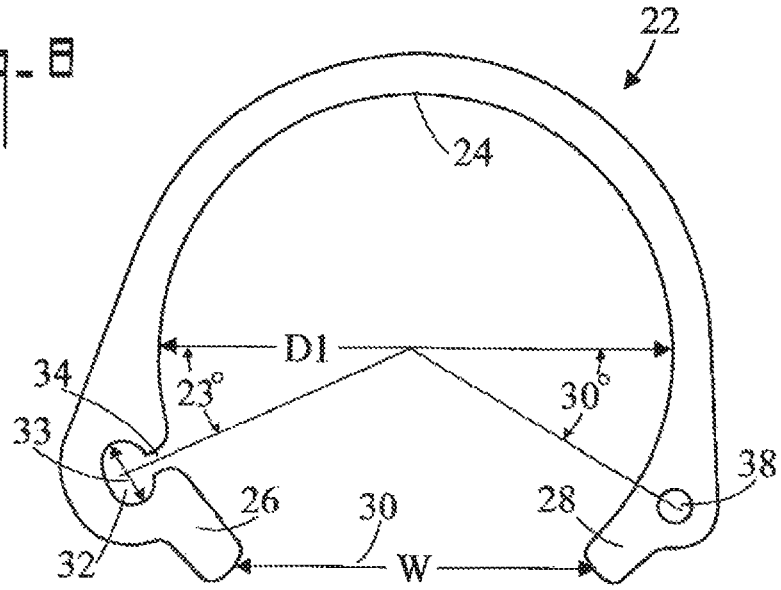
FIG. 8 is a side elevation view of a clip.
Figure 9:
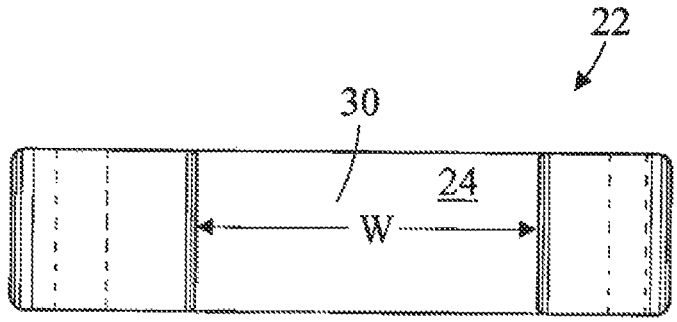
FIG. 9 is a top plan view of the clip.
Figure 10:
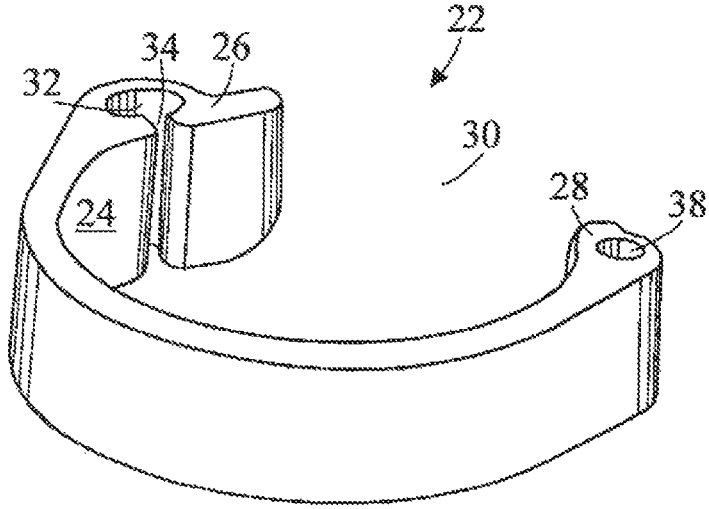
FIG. 10 is a perspective view of the clip.

FIGS. 8-10 are side elevation, top plan, and perspective views respectively of clip 22 showing inner surface 24, first jaw 26, second jaw 28, mouth 30 having width W, edge cord connector (bight) 32, neck 34, and hole 38. It is noted that the bight has an elongated portion 33 which reduces the chance of edge cord 508 inadvertently coming out through neck 34. It is also noted that clip 22 has an inner diameter D1. In the shown embodiment, edge cord connector 32 is located about 23° from inner diameter D1, and line connector (hole 38) is located about 30" from inner diameter D1.

Figures 11, 12, 13:
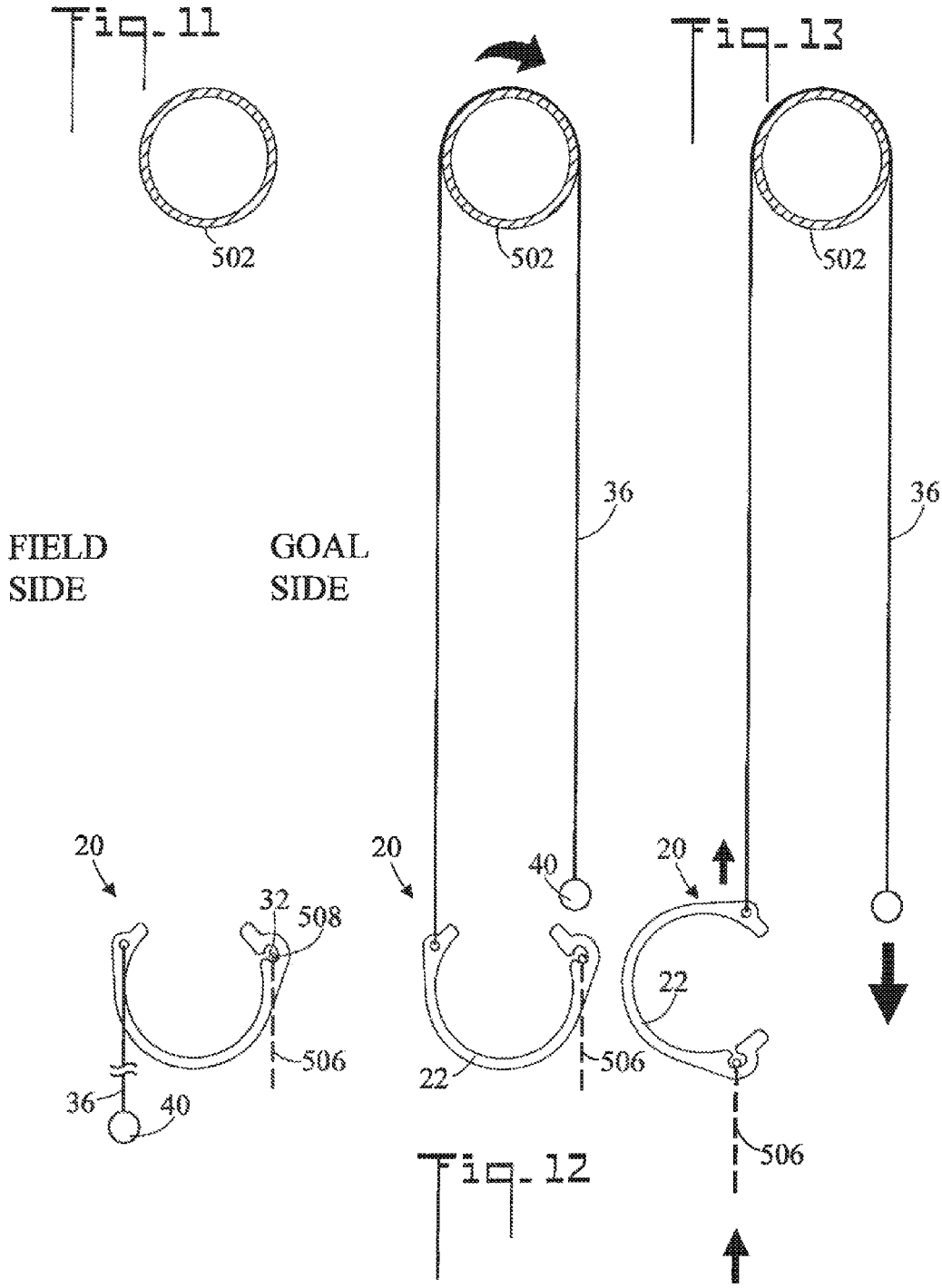
FIG. 11 is a reduced side elevation view of the device, the horizontal crossbar of the soccer goal, and the soccer net, showing the device connected to the edge cord of the soccer net.
FIG. 12 is a reduced side elevation view showing a line thrown over the horizontal crossbar.
FIG. 13 is a reduced side elevation view showing the line pulled down thereby causing the clip and the soccer net to rise toward the horizontal crossbar.

FIGS. 11-18 illustrate a method of using device 20 to connect soccer net 506 to horizontal crossbar 502. In these figures, the left side is the field side and the right side is the goal side. FIG. 11 is a reduced side elevation view showing horizontal crossbar 502 of soccer goal 500, soccer net 506, edge cord 508, and device 20 including clip 22, edge cord connector 32, line 36, and grab ball 40. Edge cord 508 of soccer net 506 is connected to edge cord connector 32 of clip 22. In the shown embodiment, this is accomplished by pressing edge cord 508 into the bight of edge cord connector 32. It is noted that device 20 and soccer net 506 are located well below horizontal crossbar 502 where they can be conveniently reached by the person making the net attachment.

FIG. 12 is a reduced side elevation view showing line 36 thrown over horizontal crossbar 502 (in the direction of the arrow) so that the grab ball 40 can be reached by the person making the net attachment. Grab ball 40 can be used to make the throw.

FIG. 13 is a reduced side elevation view showing line 36 being pulled down thereby causing clip 22 and attached soccer net 506 to rise toward horizontal crossbar 502.

Figure 14:
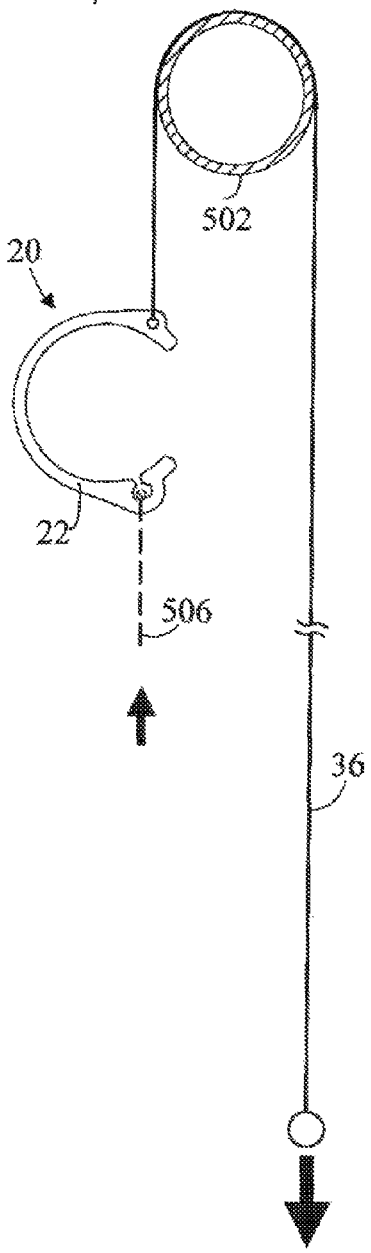
FIG. 14 is a reduced side elevation view showing the line continued to be pulled down and the clip and soccer net further rising toward the horizontal crossbar.

FIG. 14 is a reduced side elevation view showing line 36 continued to be pulled down and clip 22 and soccer net 506 further rising toward horizontal crossbar 502.

Figure 15:
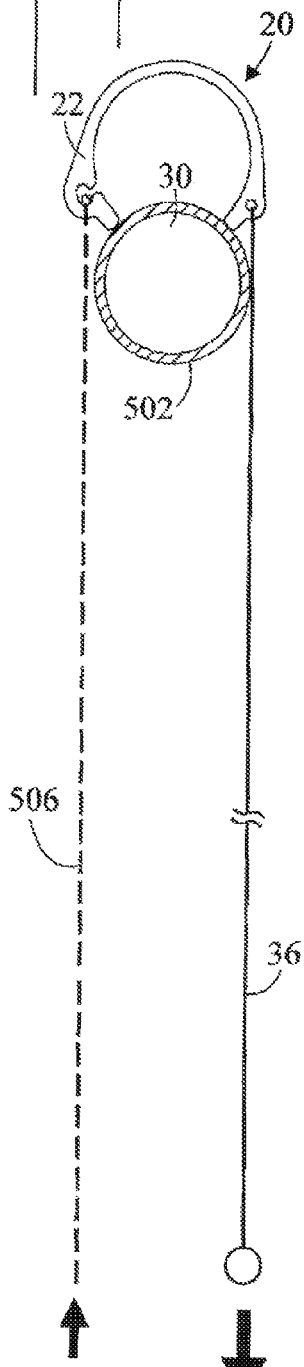
FIG. 15 is a reduced side elevation view showing the line continued to be pulled down until the clip is in a mouth down orientation on top of the horizontal crossbar.

FIG. 15 is a reduced side elevation view showing line 36 continued to be pulled down until clip 22 resides in a mouth 30 down orientation on top of horizontal crossbar 502 (also refer to FIG. 5).

Figure 16:
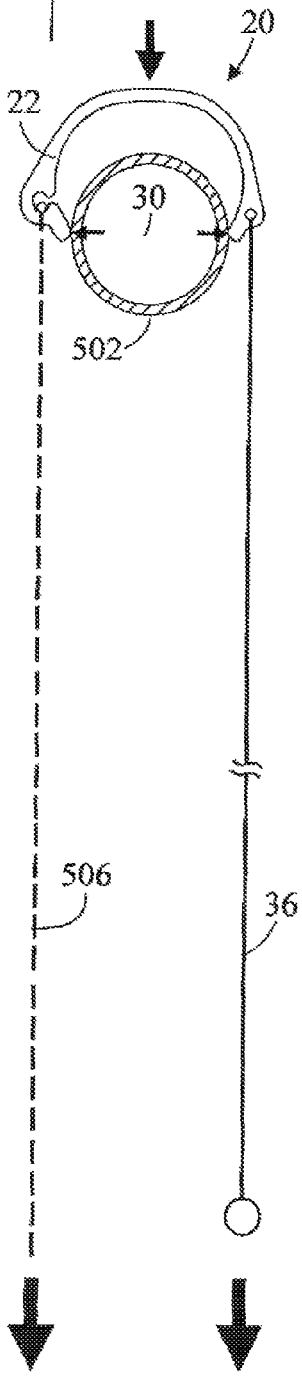
FIG. 16 is a reduced side elevation view showing the line and soccer net both simultaneously being pulled down thereby causing the mouth of clip to open and receive the horizontal crossbar.

FIG. 16 is a reduced side elevation view showing line 36 and soccer net 506 both simultaneously being pulled down thereby causing mouth 30 of clip 22 to open and clip 22 to receive horizontal crossbar 22. During the pulling, clip 22 resiliently expands around horizontal crossbar 502 (also refer to FIG. 6).

Figure 17:
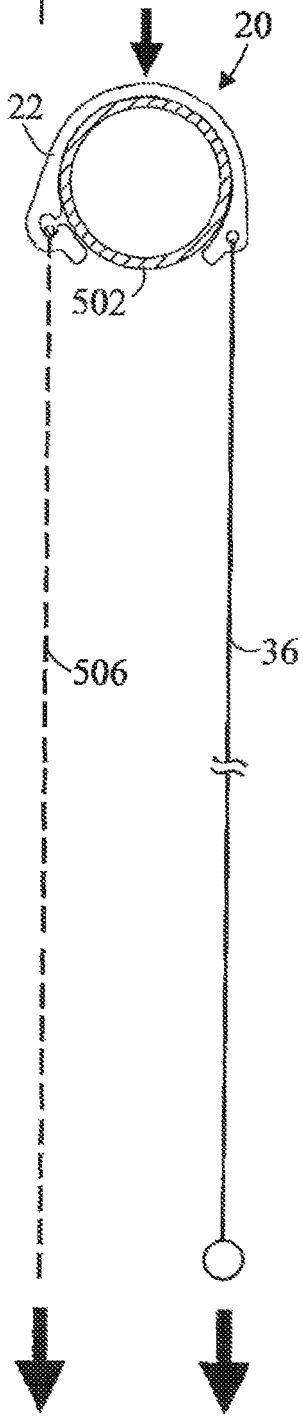
FIG. 17 is a reduced side elevation view showing the clip fully connected to the horizontal crossbar.

FIG. 17 is a reduced side elevation view showing clip 22 fully connected to horizontal crossbar 502. Line 36 and soccer net 506 are pulled down until clip 22 resiliently clamps around horizontal crossbar 502 (also refer to FIG. 7).

Figure 18:
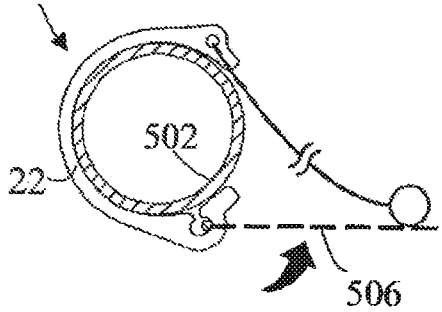
FIG. 18 is a reduced side elevation view showing the soccer net being moved to a substantially horizontal position by goal supporting elements.

FIG. 18 is a reduced side elevation view showing soccer net 506 being moved to a substantially horizontal position by goal supporting elements (not shown). In this position, soccer net 506 is ready for play. Soccer net 506 causes clip 22 to rotate away from the field side and toward the goal side.

Figure 19:
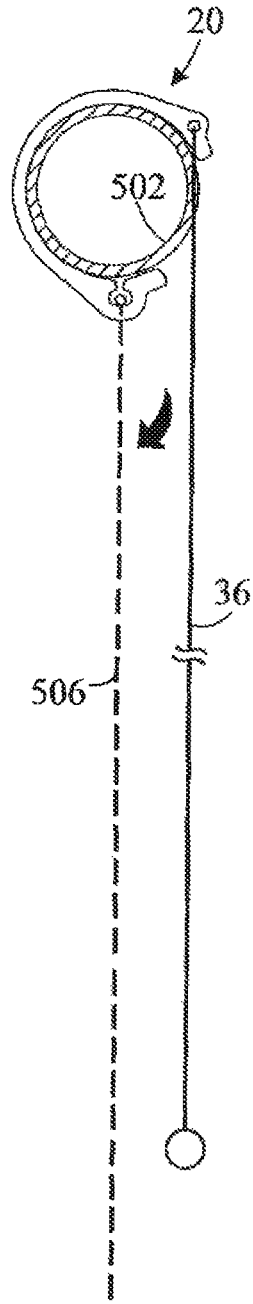
FIG. 19 is a reduced side elevation view showing the device and the connected soccer net ready to be removed from the horizontal crossbar.

FIGS. 19-22 show the process for removing soccer net 506 from horizontal crossbar 502. FIG. 19 is a reduced side elevation view showing device 20 and connected soccer net 506 ready to be removed from horizontal crossbar 502. Soccer net 506 has been disconnected from the goal support elements of FIG. 18, and hangs down as shown causing clip 22 to rotate accordingly.

Figure 20:
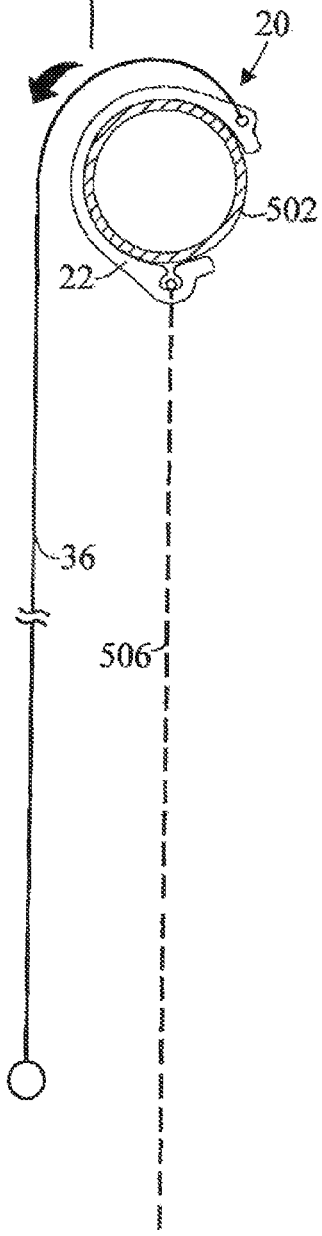
FIG. 20 is a reduced side elevation view showing the line being thrown toward the field side over the horizontal crossbar of the soccer goal.

FIG. 20 is a reduced side elevation view showing line 36 being thrown toward the field side over horizontal crossbar 502 of the soccer goal 500. Line 36 is thrown over horizontal crossbar 502 in the opposite direction from FIG. 12.

Figure 21:
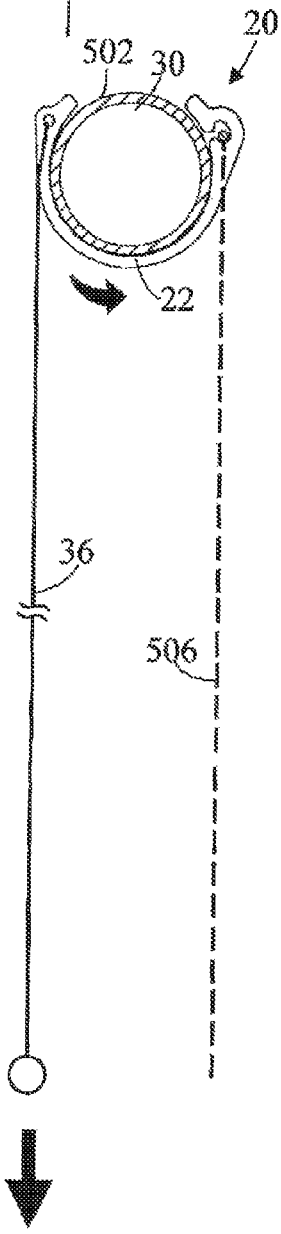
FIG. 21 is a reduced side elevation view showing the line being pulled down causing the clip to rotate to a mouth up orientation.

FIG. 21 is a reduced side elevation view showing line 36 being pulled down causing clip 22 to rotate to a mouth 30 up orientation.

Figure 22:
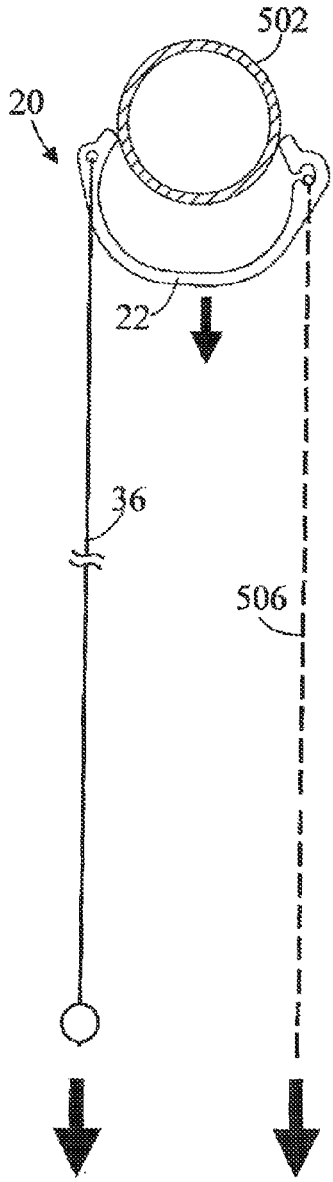
FIG. 22 is a reduced side elevation view showing the line and the soccer net both being simultaneously pulled down thereby causing the clip to disengage from the horizontal crossbar 502; and, FIG. 23 is a perspective view of the device connected around the horizontal crossbar of the soccer goal.

FIG. 22 is a reduced side elevation view showing line 36 and soccer net 506 both being simultaneously pulled down thereby causing clip 22 to disengage from horizontal crossbar 502.

As line 36 and soccer net 506 are pulled down, mouth 30 of clip 22 resiliently opens thereby pulling clip 22 off of horizontal crossbar 502.

Figure 23:
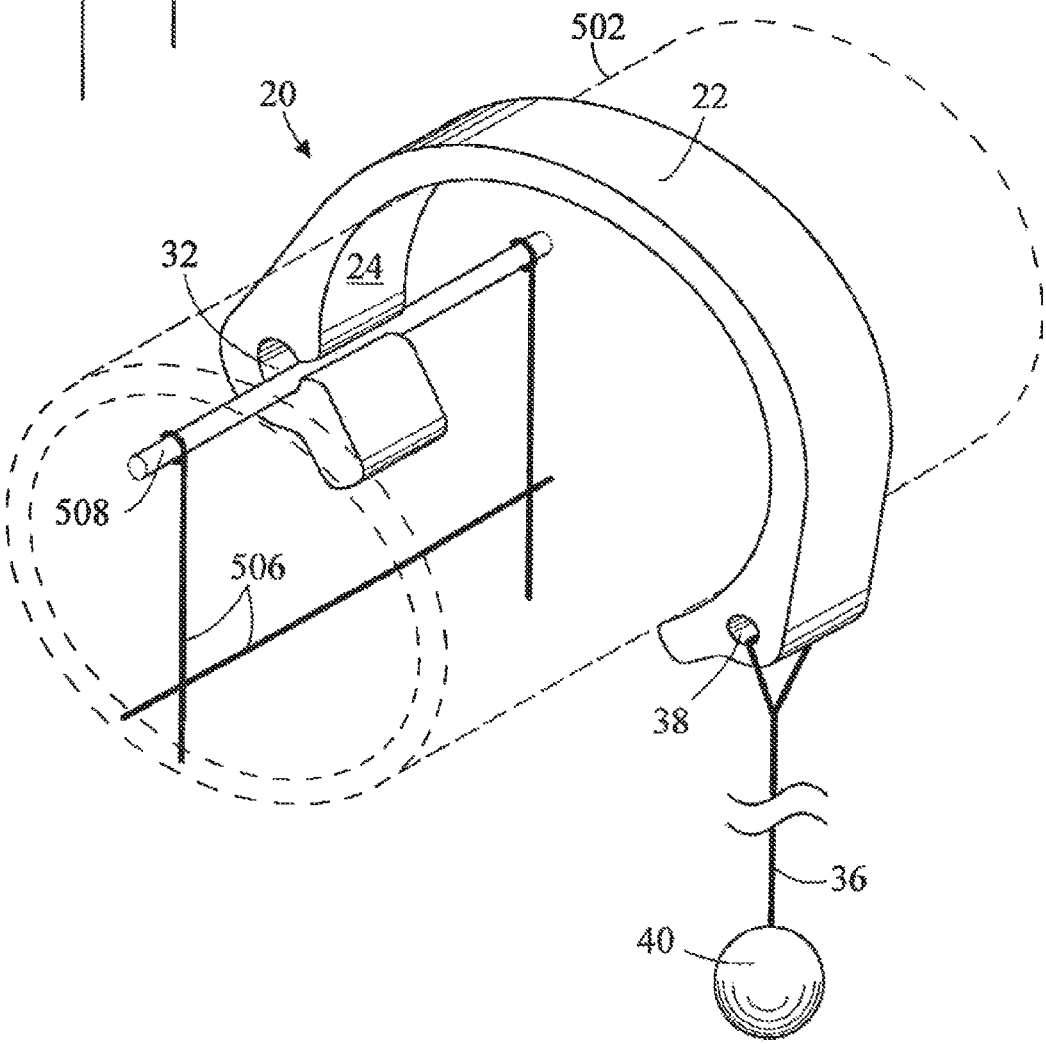

FIG. 23 is a perspective view of device 20 connected around horizontal crossbar 502 (shown in dashed lines) of soccer goal 500 showing device 20, clip 22, inner surface 24, edge cord connector 32, line 36, line connector 38, grab ball 40, soccer net 506 and edge cord connector 508. It may be appreciated that, a plurality of spaced apart devices 20 are required to connect soccer net 506 to horizontal crossbar 502.

In terms of use, a method for connecting a soccer net 506 to the horizontal crossbar 502 of a soccer goal 500 includes (refer to FIGS. 1-23):

(a) providing a soccer goal 500 having a circular horizontal crossbar 502 having a diameter D;

(b) providing a soccer net 506 having an edge cord 508;

(c) providing a device 20 for connecting soccer net 506 to horizontal crossbar 502, device 20 including;

a clip 22 having an inner surface 24 which is shaped and dimensioned to receive horizontal crossbar 502;

clip 22 having a first jaw 26 and an opposite second jaw 28 which form a mouth 30 having a width W which is less than diameter D of horizontal crossbar 502;

first jaw 26 including an edge cord connector 32 which is shaped and dimensioned to receive edge cord 508 of soccer net 506;

second jaw 28 including a line connector 38;

a line 36 connected to line connector 38; and, clip 22 being resilient so that first 26 and second 28 jaws can open to receive horizontal crossbar 502, and once received, close around horizontal crossbar 502, (d) connecting edge cord 508 of soccer net 506 to edge cord connector 32;

(e) throwing line 36 over horizontal crossbar 502;

(f) pulling down on line 36 thereby causing clip 22 and soccer net 506 to rise toward horizontal crossbar 502;

(g) continuing to pull down on line 36 until clip 22 resides in a mouth 30 down orientation on top of horizontal crossbar 502;

(h) simultaneously pulling down on both line 36 and soccer net 506 thereby causing mouth 30 of clip 22 to open and clip 22 to receive horizontal crossbar 502; and, (i) continuing to pull down on both line 36 and soccer net 506 until clip 22 resiliently clamps around horizontal crossbar 502.

The method further including:

in step (c), edge cord connector 32 including a bight in first jaw 26;

in step (c), the bight having a neck 34 through which edge cord 508 can pass; and, in step (d), causing edge cord 508 to pass through neck 34 and into the bight.

The method further including:

in step (c), line connector 38 being a hole in second jaw 28, and line 36 being connected to the hole.

The method further including removing soccer net 506 from horizontal crossbar 502 by:

(j) throwing line 36 over horizontal crossbar 502 in the opposite direction from step (c);

(k) pulling down on line 36 thereby causing clip 22 to rotate to a mouth 30 up orientation; and, (l) simultaneously pulling down on both line 36 and soccer net 506 thereby causing clip 22 to disengage from horizontal crossbar 502.

Referring to FIGS. 1-22, in another embodiment, a soccer net connection system includes a soccer goal 500 having a horizontal crossbar 502 which is circular and has a diameter D, and a soccer net 506 having an edge cord 508. The system further includes a clip 22 having an inner surface 24 which is shaped and dimensioned to receive horizontal crossbar 502. Clip 22 has a first jaw 26 and an opposite second jaw 28. First 26 and second 28 jaws form a mouth 30 which has a width W which is less than diameter D of horizontal crossbar 502. First jaw 26 includes an edge cord connector 32 which is shaped and dimensioned to receive edge cord 508 of soccer net 506. Second jaw 28 includes a line connector 38 to which a line 36 connects. In an embodiment, line connector 38 is a hole in second jaw 28. Clip 22 is resilient so that first 26 and second 28 jaws can open to receive horizontal crossbar 502, and once received, close around horizontal crossbar 502.

In an embodiment, edge cord connector 32 includes a bight in first jaw 26. The bight has a neck 34 through which edge cord 508 can pass. In another embodiment, the bight has an elongated portion 33.

In an embodiment, clip 22 has an inner diameter D1. Edge cord connector 32 is located about 23° from inner diameter D1, and line connector 38 is located about 30° from inner diameter D1.

The possible embodiments of the device and method of use described herein are exemplary and numerous modifications, combinations, variations, and rearrangements can be readily envisioned to achieve an equivalent result, all of which are intended to be embraced within the scope of the appended claims. Further, nothing in the above discussions of the device and method of use should be construed as limiting the invention to a particular embodiment or combination of embodiments. The scope of the invention is best defined by the appended claims.

I claim:

1. A device for connecting a soccer net to the horizontal crossbar of a soccer goal, the soccer net having an edge cord and the horizontal crossbar being circular and having a diameter, the device comprising:

a clip having an inner surface which is shaped and dimensioned to receive the horizontal crossbar;

said clip having a first jaw end and an opposite second jaw, said first and second jaws forming a mouth having a width which is less than the diameter of the horizontal crossbar;

said first jaw including an edge cord connector which is shaped and dimensioned to receive the edge cord of the soccer net;

said edge cord connector including a bight in said first jaw;

said bight having a neck through which the edge cord can pass;

said second jaw including a line connector;

said line connector being a hole in said second jaw;

a line which connects to said line connector; and, said clip being resilient so that said first and second jaws can open to receive the horizontal crossbar, and once received, close around the horizontal crossbar.

2. The device according to claim 1, further including:

said bight having an elongated portion.

3. The device according to claim 1, further including:

said clip having an inner diameter; and, said edge cord connector located about 23° from said inner diameter, and said line connector located about 30° from said inner diameter.

4. A soccer net connection system, comprising:

a soccer goal having a horizontal crossbar which is circular and has a diameter;

a soccer net having an edge cord;

a clip having an inner surface which is shaped and dimensioned to receive said horizontal crossbar;

said clip having a first jaw and an opposite second jaw, said first and second jaws forming a mouth having a width which is less than said diameter of said horizontal crossbar;

said first jaw including an edge cord connector which is shaped and dimensioned to receive said edge cord of said soccer net;

said edge cord connector including a bight in said first jaw;

said bight having a neck through which said edge cord can pass;

said second jaw including a line connector;

said line connector being a hole in said second jaw;

a line which connects to said line connector; and, said clip being resilient so that said first and second jaws can open to receive said horizontal crossbar, and once received, close around said horizontal crossbar.

5. The system according to claim 4, further including:

said bight having an elongated portion.

6. The system according to claim 4, further including:

said clip having an inner diameter; and, said edge cord connector located about 23° from said inner diameter, and said line connector located about 30° from said inner diameter.

7. A method for connecting a soccer net to the horizontal crossbar of a soccer goal utilizing the device of claim 1 or claim 1, comprising:

(a) providing a soccer goal having a horizontal crossbar, said horizontal crossbar being circular and having a diameter;

(b) providing a soccer net having an edge cord;

(c) providing a device for connecting said soccer net to said horizontal crossbar, said device including;

a clip having an inner surface which is shaped and dimensioned to receive said horizontal crossbar;

said clip having a first jaw and an opposite second jaw, said first and second jaws forming a mouth having a width which is less than said diameter of said horizontal crossbar;

said first jaw including an edge cord connector which is shaped and dimensioned to receive said edge cord of said soccer net;

said second jaw including a line connector;

a line connected to said line connector; and, said clip being resilient so that said first and second jaws can open to receive said horizontal crossbar, and once received, close around said horizontal crossbar, (d) connecting said edge cord of said soccer net to said edge cord connector;

(e) throwing said line over said horizontal crossbar;

(f) pulling down on said line thereby causing said clip and said soccer net to rise toward said horizontal crossbar;

(g) continuing to pull down on said line until said clip resides in a mouth down orientation on top of said horizontal crossbar;

(h) simultaneously pulling down on both said line and said soccer net thereby causing said mouth of said clip to open and said clip to receive said horizontal crossbar; and, (i) continuing to pull down on both said line and said soccer net until said clip resiliently clamps around said horizontal crossbar.

8. The method of claim 7, further including:

in step (c), said edge cord connector including a bight in said first jaw;

in step (c), said bight having a neck through which said edge cord can pass; and, in step (d), causing said edge cord to pass through said neck and into said bight.

9. The method of claim 7, further including:

in step (c), said line connector being a hole in said second jaw, and said line being connected to said hole.

10. The method of claim 7, further including removing said soccer net from said horizontal crossbar by:

(j) throwing said line over said horizontal crossbar in the opposite direction from step (e);

(k) pulling down on said line thereby causing said clip to rotate to a mouth up orientation; and, (l) simultaneously pulling down on both said line and said soccer net thereby causing said clip to disengage from said horizontal crossbar.

* * * * *